United States Patent [19]

Blessing et al.

[11] 4,019,447

[45] Apr. 26, 1977

[54] APPARATUS FOR AUTOMATICALLY CONTROLLING MOVEMENT OF MATERIAL WITH RESPECT TO A WORK POINT IN A MACHINE

[75] Inventors: Hubert Blessing, Dallas, Tex.; Kenneth A. Benjamin, Wilton, Conn.

[73] Assignee: Ivanhoe Research Corporation, Stamford, Conn.

[22] Filed: Sept. 19, 1975

[21] Appl. No.: 614,936

[52] U.S. Cl. ..... 112/121.11; 112/153; 112/204

[51] Int. Cl.[2] ..... D05B 19/00

[58] Field of Search ..... 112/121.11, 121.12, 112/121.15, 204, 205, 214, 203, 153, 102; 271/53

[56] References Cited

UNITED STATES PATENTS

| | | | |
|---|---|---|---|
| 2,979,745 | 4/1961 | Schaefer, Jr. et al. | 112/211 X |
| 3,066,625 | 12/1962 | Reeber et al. | 112/214 |
| 3,650,229 | 3/1972 | Rouin | 112/121.11 |
| 3,693,561 | 9/1972 | Hrinko, Jr. et al. | 112/153 X |

*Primary Examiner*—H. Hampton Hunter
*Attorney, Agent, or Firm*—Parmelee, Johnson & Bollinger

[57] ABSTRACT

Apparatus for automatically controlling movement of an area of material with respect to a work point in a machine in which revolvable control means continuously engages the region of the material in front of the work point and in close proximity to that point. An exemplification of the invention is in a sewing machine in which pressure exerting means urges revolvable control means into guiding engagement with that front region in the fabric as the material advances over the support toward the work point, for guiding and smoothing the fabric material and enabling a wide variety of stretchable as well as stiff fabrics to be guided quickly, accurately and effectively. Reversible drive means moves the revolvable control means laterally toward the right or left for lateral guidance of said front region of the fabric material in front of the work point to produce the desired stitching path, and control means are provided for operating the apparatus which may follow a contrasting portion of the workpiece such as its edge. The revolvable control means may be arranged to exhibit a differential frictional action so as to exert a greater frictional engagement with the fabric workpiece with respect to movement laterally, i.e. to the right or left, as compared with the effect of the control means upon advancing workpiece.

13 Claims, 8 Drawing Figures

FIG. 7
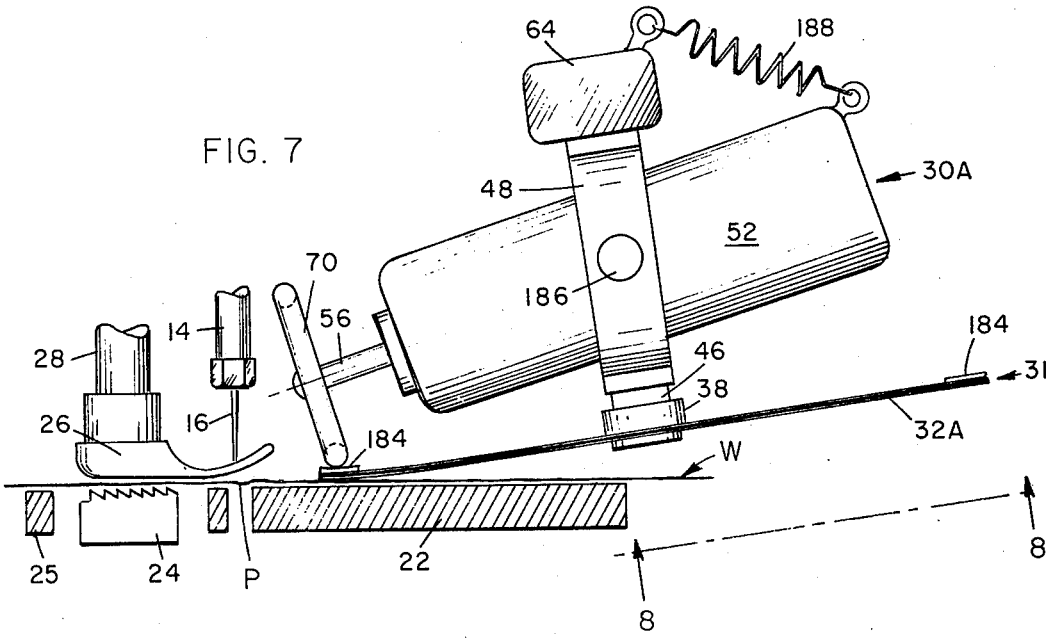
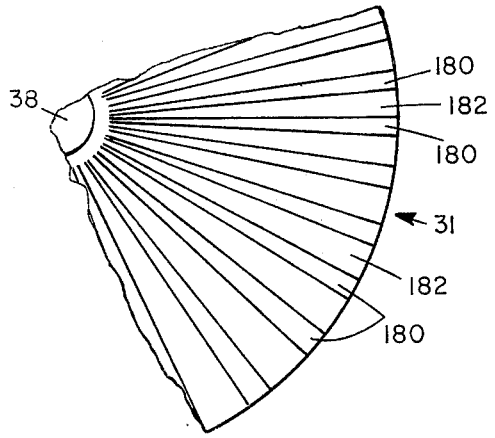
FIG. 8

APPARATUS FOR AUTOMATICALLY CONTROLLING MOVEMENT OF MATERIAL WITH RESPECT TO A WORK POINT IN A MACHINE

FIELD OF THE INVENTION

This invention relates to apparatus for automatically guiding an area of material toward a work point in a machine in which revolvable control means continuously engages the region of the meterial in front of the work point. The illustrative embodiment of the invention relates to apparatus for automatically controlling the course of advancing movement of a region of fabric material being fed over a work support surface toward the work point of a fabric fastening machine, this work point being the point where the material is joined or fastened by suitable fastening means, for example such as by thermal or sonic welding or bonding or by stitching by a reciprocating needle piercing the fabric material to form stitches therein. The fabric material being guided may include one or more plies or layers.

SUMMARY OF THE PRIOR ART

In many sewing devices, fabric material is mechanically fed over a work supporting surface past a needle work point such as in manufacture of garments, clothing, household furnishings and sails. While the feed is mechanical, the course of the fabric material must usually be manually varied or controlled as, for example to follow the edge or some predetermined path on the material, such as a pattern or seam on the material, or the like. For instance, when cloth or leather is fed through a sewing machine, while the feed is effected mechanically by the sewing machine feed machanism, an operator guides the material in order to maintain the desired stitch line, or to follow the contour of the material edge.

Alternatively, a predetemined program, for example as provided by cam means, may be used to control the movement of the material relative to the work point.

An automatic guide for sheet material is described and claimed in U.S. Pat. No. 3,650,229 of Herman Rovin, issued Mar. 21, 1972, and assigned to the same assignee as the present application. In that patent, a rotatable gripping means, such as a contact ring, encircles the work point and is arranged to intermittently engage the sheet material, synchronously with the action occurring at the work point. That is, the gripping means is moved away from engagement with the sheet material when the feed dogs are advancing the material. The gripping means is moved into contact with the sheet material when the needle is acting on the workpiece. As explained in that patent, the gripping means, such as an annular friction ring, may be located above or below the sheet material and is driven to have rotational movement about the work point. The gripping means in that patent contacts the sheet material at least over a series of points, preferably over an area at least in part surrounding the work point and the position of the gripping means in contact with the sheet material moves relative to the work point in the plane of the sheet material while the gripping means is exerting its guiding action.

In summary, the gripping means in that patent must be reciprocated into and out of engagement with the sheet material. Guiding can be applied to the material only during a portion of each stitching cycle, namely, during that portion when the feed dogs are not advancing the material, and then guiding only occurs when the gripping means is actually engaged with the material in the plane of the material. Since the material is guided by rotational movement about the work point, the material must have sufficient stiffness to be guided by such rotational movement of the intermittently acting gripping means. Moreover, there is a limitation as to the smallness of the goods which can be practically handled in that prior art apparatus, because the material to be guided must be sufficiently large that it extends out to the radius of rotation of the annular friction ring, which, in turn, must be sufficiently large to surround the needle mechanism and equipment associated with the needle, such as the needle bar, presser foot and its mounting. Since the guide means is reciprocated into and out of engagement with the sheet material, it is intended for use with an intermittent feed as in a sewing machine, and moreover the speed of operation is limited by the inertia of the reciprocating means involved.

Work feeding and quiding means for operating on or near the irregularly curved margin of a workpiece such as a leather piece of a shoe is shown in U.S. Pat. No. 2,979,745, of Hans F. Schaefer, Jr., et al., assigned to United Shoe Machinery Corporation. In that patent, a pair of workpiece feeding and guiding wheels engage the workpiece in a position off at the same side of the needle, one of these wheels being spaced farther from the needle than the other. One of these wheels is driven either forward or backward with variable speed according to the curvature of the margin of the workpiece while the second wheel is driven in the same forward or backward direction with a speed which is fixedly proportionate to the speed of the first wheel such that their forward or backward rotation and the differential in their speeds causes the workpiece to be fed and to be steered about a common turning point. Again, it is seen that the workpiece must have sufficient stiffness, such as in a leather piece to be fed and steered in this manner by a pair of differentially acting wheels. In addition, it is seen that a complex drive mechanism is involved in differentially rotating this pair of workpiece feed and guide wheels in the Schaefer, Jr., et al. patent. The work feeding and guide means shown in the Schaefer, Jr. et al. patent appear to be limited by their complexity and by their differential action as to the speed of operation and as to size of workpiece which can be handled. In particular, the mechanism shown therein is not capable of handling pliable workpieces or workpieces such as straps which are extremely narrow in the direction perpendicular to the sew line. Moreover, in the mechanism shown in Schaefer, Jr. et al. an intermittently operative hammer and anvil impart step-by-step feeding movement, and the work control wheels effectively exert a steering force on the workpiece only when the hammer is out of work-gripping relation to the anvil so that such complex mechanism is, in all likelihood, incapable of keeping up with present-day high speed sewing machine.

A system for automatically guiding the work in a sewing machine for maintaining a line of stitching parallel to the straight edge of the fabric is shown in U.S. Pat. No. 3,417,718 — Anderson. The Anderson prior art system suffers the severe limitation that it only guides a line of stitching parallel to the straight edge of the fabric.

SUMMARY OF THE INVENTION

In accordance with the illustrative embodiments of the present invention any and all kinds of fabric material can be automatically guided, regardless of their stiffness or compliance. Revolvable control means continuously engage the region of the fabric material in front of the work point and in close proximity to the work point as the fabric material advances over the fabric support toward the work point. Thus, the revolvable control means continuously imposes a controlling guiding action on the material in front of the work point where the needle acts on the material. The revolvable control means is well adapted to be located in close proximity ahead of this work point. This revolvable control means includes a revolvable member or members which can be revolved laterally to the left or right in said region of contact with the fabric material to produce a lateral displacement of the material immediately in front of the needle, so as to steer the material approaching the needle.

The revolvable control means may be arranged to exhibit a differential frictional action so as to exert a greater frictional engagement with the fabric workpiece with respect to lateral movement thereof as distinguished from the action of the control means upon the advancing movement of the workpiece. The continuous controlling guiding action imposed on the material by the revolvable control means provides effective quick and accurate steering even when handling very compliant fabric material, such as knit goods.

Advantageously, the automatic fabric material guiding apparatus embodying the present invention in use in conjunction with a sewing machine will automatically guide the fabric material, so that the sewing machine will stitch along straight and/or curved stitching paths, including reverse curves, S-curves and irregularly curved paths. The apparatus is so quick and effective in action that the sewing machine will sew along a circular stitching path of small radius even where the circular path has a radius as small as one and one-half inches, being guided by sensing a contrasting region of a workpiece, such as the edge of a circular workpiece. The guiding action is so accurate that if the sewing is continued for several trips around near the edge of the circular workpiece, then the subsequent paths of stitching will fall on top of, or be adjacent to, the initial circular path of stitching.

Advantageously, the apparatus can be controlled automatically to produce a pre-programmed path of stitches in a workpiece or can be controlled automatically by a contrasting portion of the workpiece, such as a contoured edge of the workpiece or a contrasting pattern on the workpiece or by a border portion or by the contrast of an additional layer of layers on the workpiece.

As used herein, the term "fabric" or "fabric material", or "work material", is intended to include woven goods and also non-woven, knitted, felted, absorbent, imperforate and perforate goods, porous and non-porous goods either having a fabric like texture suitable for use in garments, clothing, headgear, footwear, home furnishings, sails, components thereof and similar uses, or having rigid characteristics, such as sheet material for use in industrial applications and regardless of whether the material is in one layer or multiple layers, or in one ply or multiple plies, and regardless of whether the goods are natural, synthetic, or blended and regardless of whether the goods include animal fibers, vegetable fibers, paper material, or combinations thereof or other material. The term "workpiece" is intended to include individual pieces, as well as subassemblies or semi-finished goods including one or two or more pieces having components secured together as by suitable fastening means.

The various objects, aspects and advantages of the present invention will be more fully understood from a consideration of the following description in conjunction with the accompanying drawings of illustrative embodiments of the invention wherein similar reference nembers refer to corresponding parts throughout.

BRIEF DESCRIPTION OF THE DRAWINGS

FIG. 7 is a view similar to FIG. 2 and showing a modified form of the automatic workpiece guiding apparatus including revolvable control means contacting the workpiece; and FIG. 8 is a bottom plan view of a ribbed disc portion of the revolvable control means of FIG. 7.

As shown in FIGS. 1 and 2 of the drawings, the sewing machine 10 includes a sewing head 12 with a reciprocating needle holding member 14 which intermittently moves a needle 16 to pierce the fabric material 18 at a work point P (FIG. 4) for forming stitches in the fabric material. This fabric material is included in a workpiece W, which is resting on a suitable support 20, shown as the table of the sewing machine. Inserted in the table 20 is a work support plate 22, for example of polished metal, providing an upper surface offering relatively low friction to the fabric material 18 passing over it.

Figure 1:
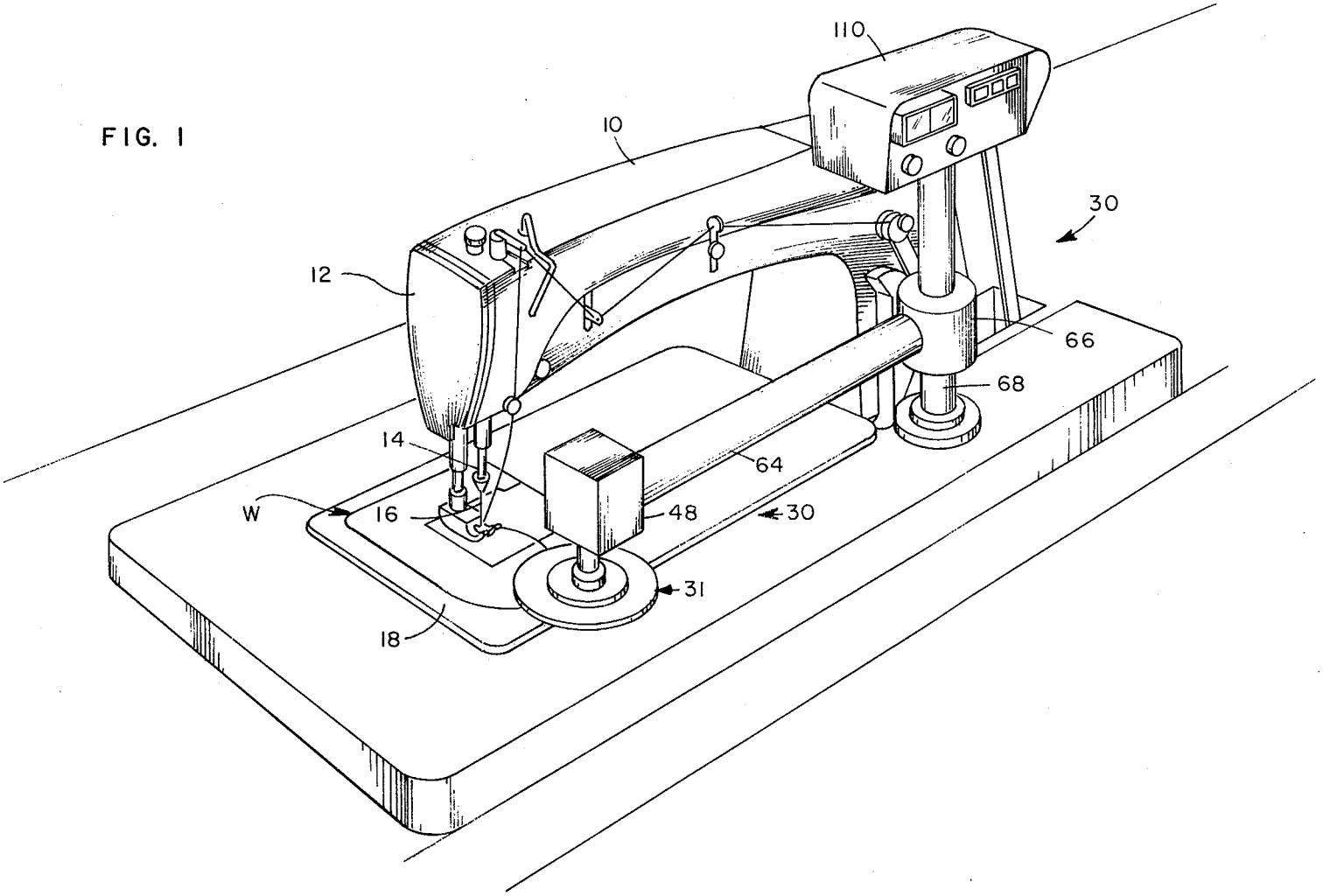
FIG. 1 is a perspective view of a sewing machine provided with an embodiment of the automatic fabric material guiding apparatus in accordance with the invention.

The sewing machine 10 has feed mechanism which mechanically advances the fabric material over the support 22. For example, the feed mechanism may include one or more reciprocable feed dogs 24 (FIGS. 2 and 4) operating through elongated slots 25 in the fabric support 22. A presser foot 26 (FIGS. 1 and 2) may be provided on a rod 28 for pressing the fabric down near the needle.

Figure 4:
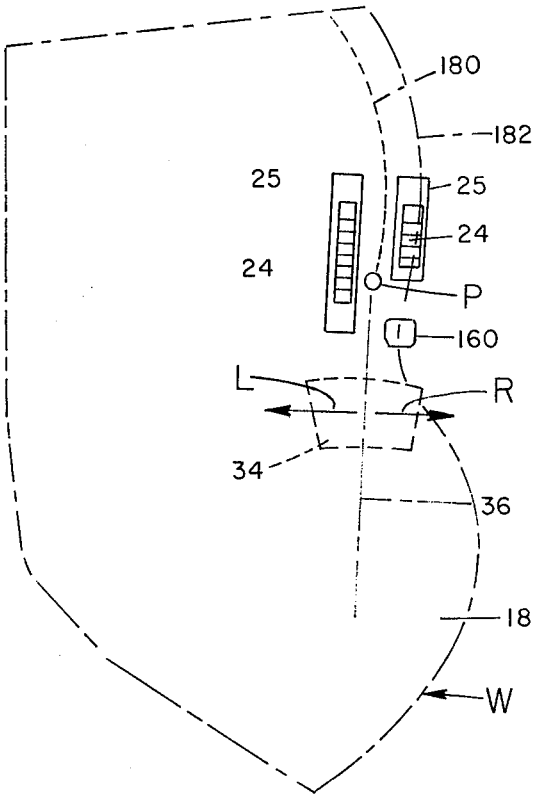
FIG. 4 is a plan sectional view as seen looking down along the plane 4—4 in FIG. 2.

The automatic fabric material guiding apparatus, generally indicated at 30 in FIG. 1, includes revolvable control contacting means 31 capable of exerting frictional force in a lateral direction and adapted to be pressed against the fabric material 18 in guidance contact with a localized region 34 (FIG. 4) of the material in front of the needle work point P and in close proximity thereto. As shown in FIG. 4, the dash and dotted line 36 is the direct line of approach to the work point P, and the localized region 34 lies on this approach line 36. The revolvable contacting means 31 is intended to have a relatively great coefficient of friction with respect to lateral motion across the surface of the fabric material 18 with which it is engaged. As the revolvable means 31 moves laterally against the region 34 the frictional contact exerts a lateral force for steering the workpiece W to the left or right, depending upon the direction of rotation thereof.

This revolvable control contacting means 31 is shown as including a flexible disc 32 of natural gum rubber held by a central clamping disc 36 to the flange of a hub 38, secured by screws 39. A stiffly resilient back-up member 40, in the form of a thin spring steel disc having approximately the same diameter as the disc 32 is positioned adjacent thereto and is similarly clamped to the mounting hub 38. This mounting hub is fastened as by a pin 41 to a rotatable shaft 42 journaled in a pair of bearings 44 and 46 in a carriage 48. Thus, the revolvable contacting means 31 is revolvably mounted for turning in either direction.

Figure 2:
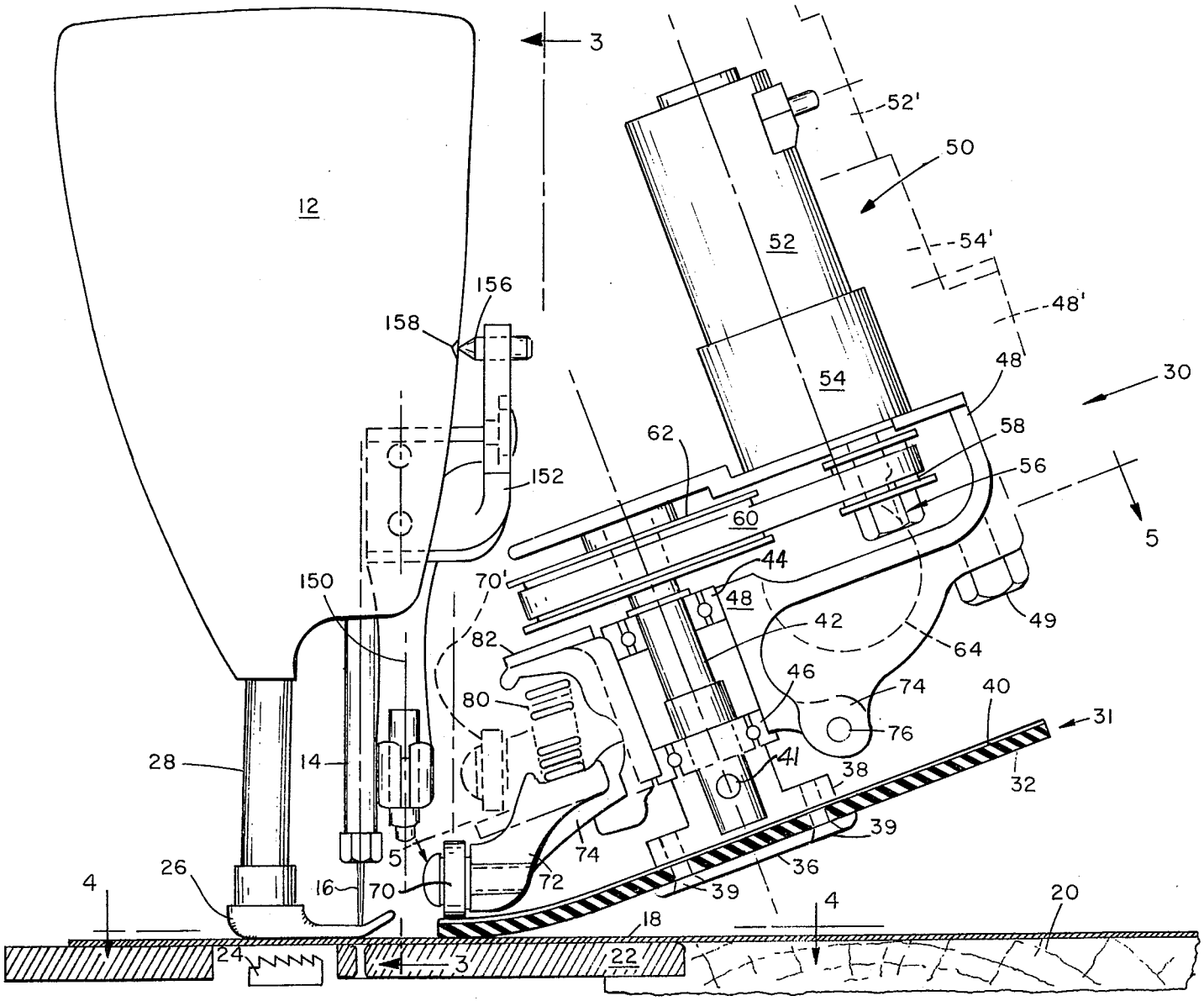
FIG. 2 is an elevational view of the sewing head of the sewing machine shown on enlarged scale with respect to FIG. 1 and with the frictional contacting means of the automatic guiding apparatus shown frictionally engaging the region of the fabric material in close proximity in front of the needle work point.

Reversible drive means, generally indicated at 50 in FIG. 2, are mounted on the carriage 48 for revolving the control means 31 in either direction. This reversible drive means 50 comprises a servo motor 52 connected by means of a speed-reducing gear box 54 to a drive shaft 56 carrying a drive pulley 58. This pulley 58 is of the positive-drive type having teeth engaging notches in a belt 60 which in turn drives a larger similar pulley 62 attached to the shaft 42.

Figure 3:
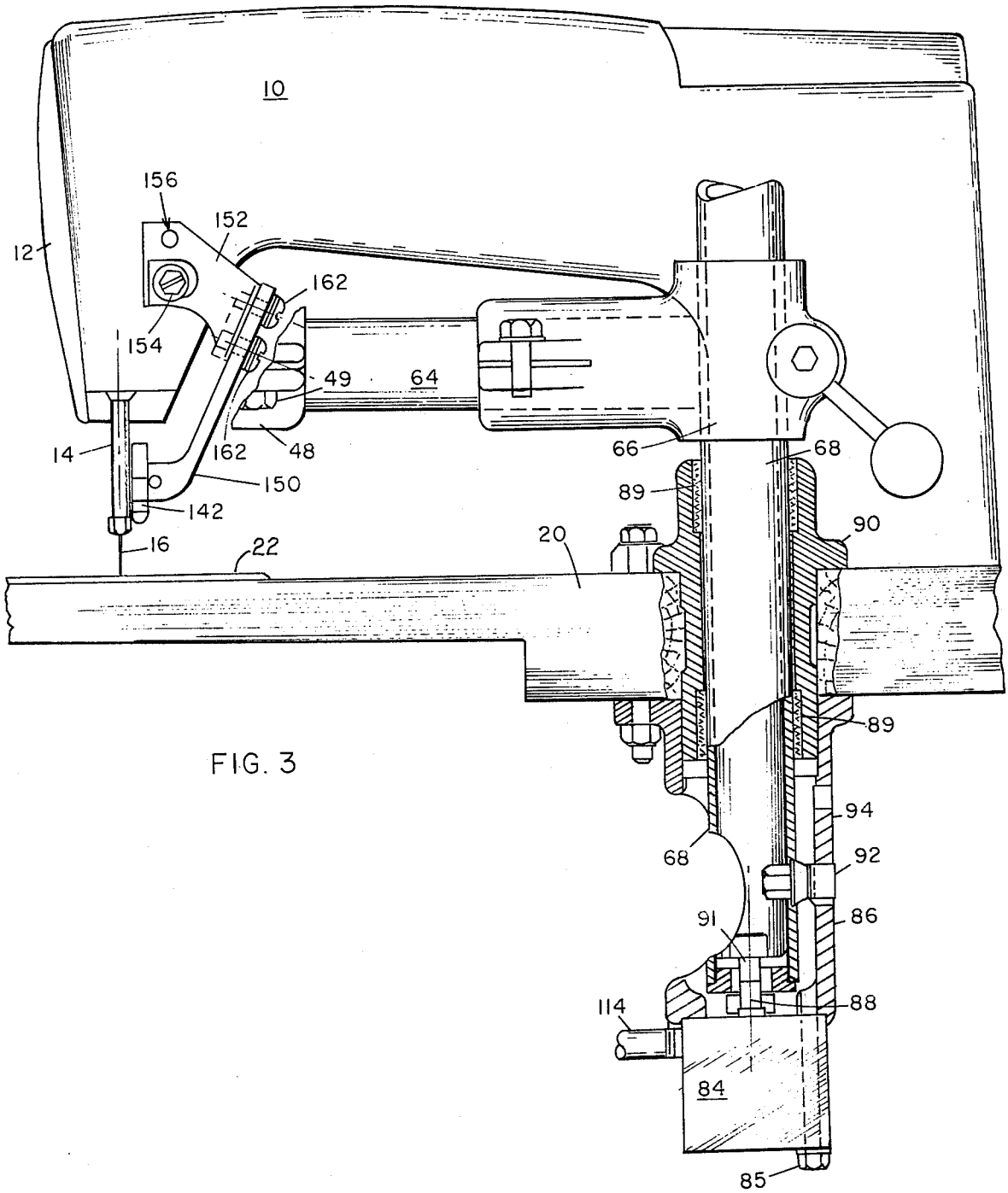
FIG. 3 is an elevational sectional view as seen looking toward the left along the line 3—3 in FIG. 2.

The carriage 48 is secured by machine screws 49 (FIG. 2) to a support arm 64 (FIG. 1) held by an adjustable clamp bracket 66 carried by an elevator column 68, as seen also in FIG. 3. This clamp bracket 66 can be adjusted in position on the elevator column in order to position the contact region 34 (FIG. 4) directly in front of the needle work point P and in close proximity thereto. The operation of the elevator column 68 will be described in detail further below.

Figure 5:
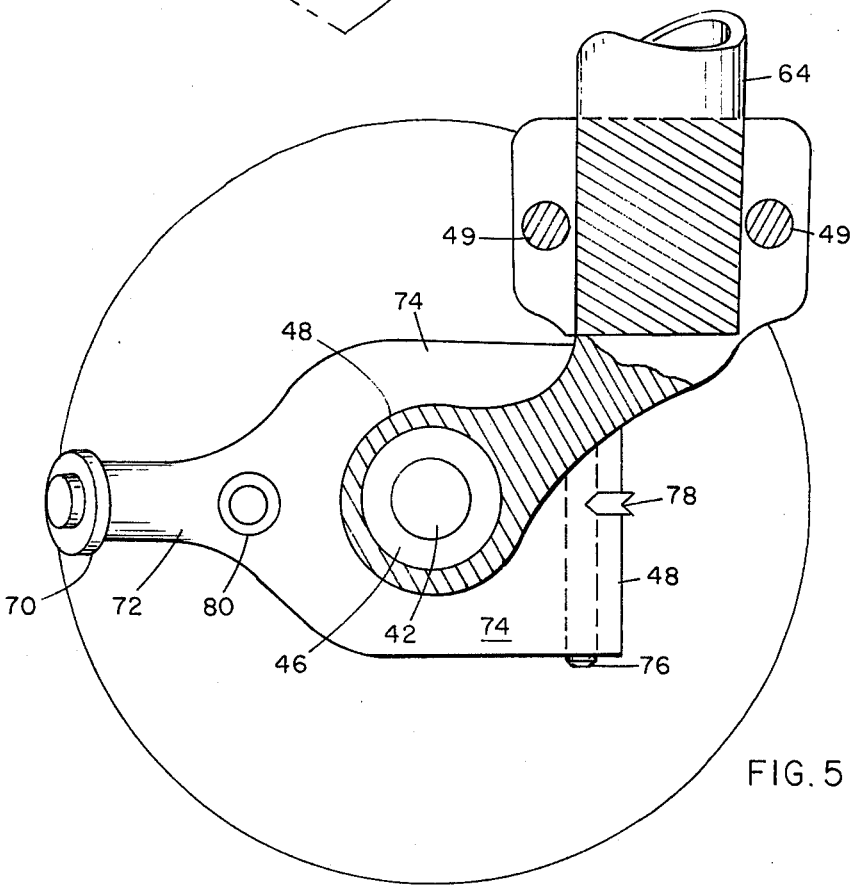
FIG. 5 is a plan sectional veiw as seen looking down along the section line 5—5 in FIG. 2.

In order to press the revolvable control means 31 down against the fabric material in the region 34, there may be provided a small pressure wheel 70 (FIGS. 2 and 5) which rides upon the peripheral area of the back-up member 40. Such a wheel may be mounted on a presser arm 72 having a yoke 74 attached to the carriage 48 by a hinge pin 76 fixed by a set screw 78. The presser arm 72 with its yoke 74 can be swung up and down about the hinge mounting 76. A compression spring 80 (FIG. 2) seats between the arm 72 and an abutment 82 on the carriage 48. This spring serves to exert a downward force on the pressure wheel 70.

With reference to FIG. 3, the elevator column 68 may be automatically moved up and down when desired, in order to lift the revolvable control means 31 a short distance away from the support plate 22 for providing clearance for insertion of a workpiece into the needle workpoint. A pneumatic lift cylinder 84 is attached by machine screws 85 to a fixed frame 86 and has its piston rod 88 connected to the lower end of the column 68 by a swivel connection 91. This column is vertically slidable within sleeve bearings 89 in a mounting collar 90 anchored to the sewing machine table 20.

To clear the sewing head 12 (FIG. 2), the elevator column is turned slightly during its elevation. A cam follower roller 92 (FIG. 3) fastened to the column 68 and engaging in a helical slot 94 in the fixed frame 86 causes the column to turn slightly during its upward motion. The elevated or retracted position 48' of the carriage 48 can be judged in FIG. 2 by noting the relative retracted position 70' of the pressure wheel 70. Thus, when the revolvable control means 31 is lowered into its active position, as shown by the full drawing in FIG. 2, it is swung toward the needle work point so as to frictionally engage the fabric in the region 34 (FIG. 4) in close proximity to the work point P and straddling the line 36 of the direct approach to the point P.

Figure 6:
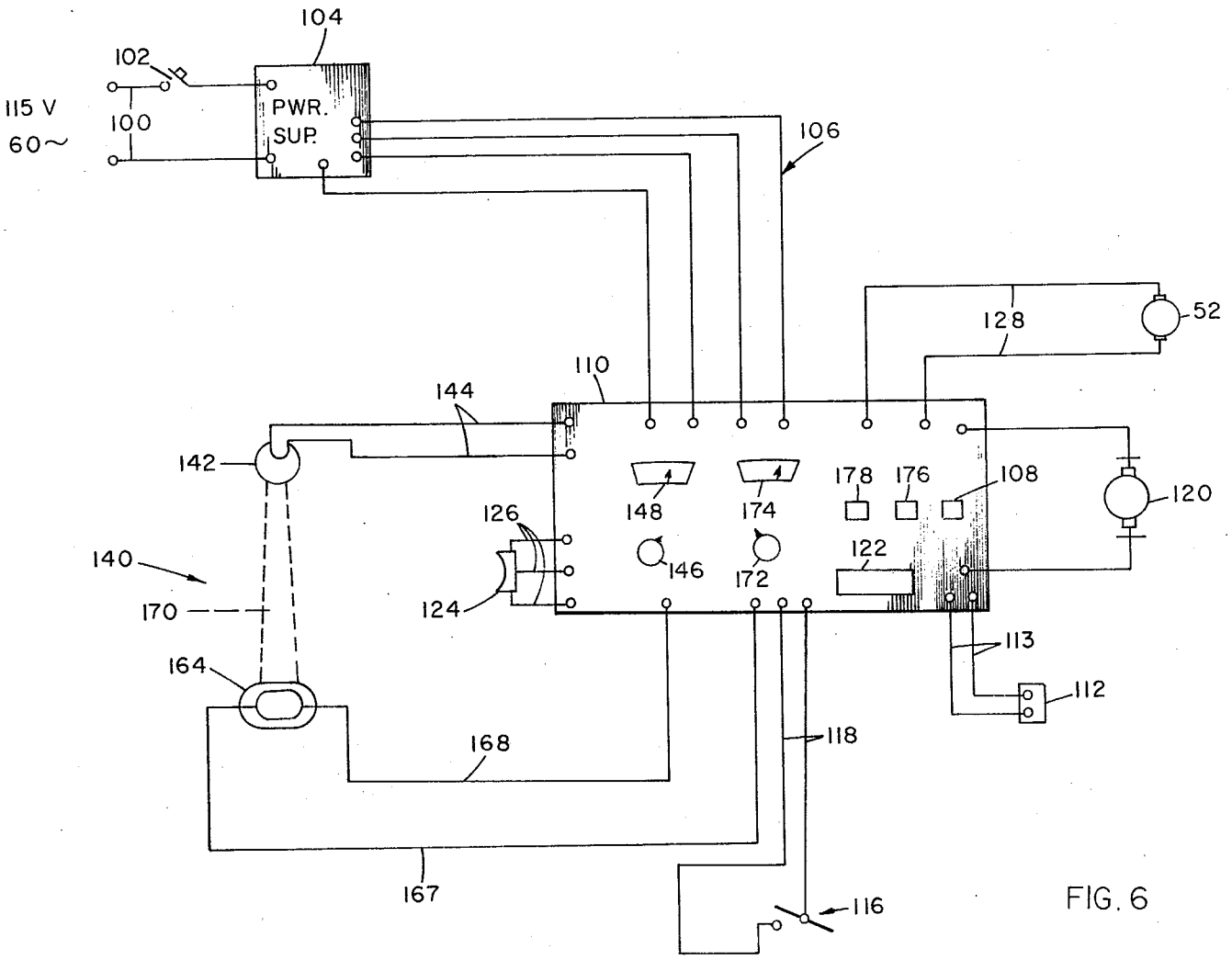
FIG. 6 is a schematic circuit diagram of the controls.

Shown in FIG. 6 is the control circuit for the apparatus described above. Electrical power is supplied from a suitable source, for example 115 volt, 60 Hertz power lines 100 through an on-off switch 102 to a power supply 104 which is connected by conductors 106 to an electronic control unit 110 having an on-off switch 108. Closing the switch 108 turns on the control 110 and energizes a solenoid valve 112 through leads 113. When energized, this solenoid valve 112 feeds air through an air line 114 (FIG. 3) to the lift cylinder 84 for raising the carriage 48 to its inactive or retracted positon 48' (FIG. 2).

In a semi-automatic system, there is a foot peddle switch 116 connected by leads 118 to the control unit 110. This switch 116 is closed when the operator pushes down on the toe of the switch and is opened when the operator presses backward on the heel. After the operator has placed the workpiece W in its its initial position, the switch 116 is closed, and the electronic control 110 automatically de-energizes the solenoid valve 112 for lowering the carriage 48 to its active position. Alternatively, the initial positioning of the workpiece and the lowering of the carriage 48 into its operating position may be arranged to be fully automatically controlled by pre-programmed control means, such as a program card.

After a momentary delay, the sewing machine motor 120 is energized to commence the stitching cycle. The stitching cycle may be pre-programmed for an automatically predetermined pattern by inserting a program card into the slot 122 in the control unit. A machine revolution counter 124, for example such as a magnetically actuated proximity switch, senses each rotation of the sewing machine. This revolution counter 124 is connected by leads 126 to the electronic control 110 and feeds electrical pulses to the control so as to count the number of stitches which have been made. The servo motor 52 is connected by leads 128 to the control unit 110 and also may have a permanent magnet field so as to be reversible upon reversal of the direction of current flow therethrough. The program card which may be inserted into the slot 122 predetermines the number of stitches which are to be made and also controls the servo motor 52 for guiding the fabric material. Alternatively, suitable sensing means, for example such as a photocell may serve to sense the end of the desired stitching path, as by sensing the end of the workpiece, for stopping the stitching action.

Upon the pre-programmed completion of the predetermined stitching program, or upon sensing the end of the desired stitching path, the electronic control unit 110 automatically de-energizes the sewing machine motor 120 and energizes the solenoid valve 112 for retracting the fabric guiding carriage 48.

In order to guide the fabric material automatically with respect to a contrasting portion of the workpiece, for example such as an edge portion, or the edge of an overlapping layer or ply, or the edge of a pattern on the fabric material, sensing means 140 are provided. These sensing means include a light source 142 connected by leads 144 with the control unit 110. A manually rotatable knob 146 may be provided to control the brightness of this light source by adjusting the amount of electrical current being fed to its tungsten filament, and this current flow may be shown by a meter 148. Thus, the sensitivity of the sensing means 140 may be adjusted, depending upon density and color of the workpiece. Alternatively, the intensity of the light source 142 may be held constant, and the sensitivity of the control circuit may be adjusted by the control means 172, 174 to provide the desired responsiveness to the particular type of workpieces actually being controlled, e.g. to adjust a bias voltage for setting the null point of response to the photocell. The meter 174 indicates the level of this bias voltage.

FIG. 3 shows this light source 142 positioned by a light holder 150 attached by a bracket 152 and a machine screw 154 to the sewing machine head 12. A registering pin 156 engages in a socket 158 (FIG. 2) in the head 12 for accurately registering the light source in the desired position directly above an aperture 160 (FIG. 4) in the work support plate 22. The light holder 150 is adjustably attached to the bracket 152 by suitable fastening means 162 such as a pair of nuts, bolts and lock washers.

The sensing means 140 may include one or more photocells. A photocell 164 is shown connected by a pair of leads 167 and 168 to the control unit 110. This photocell is shown located below the aperture 160 extending across the width of this aperture as shown in FIG. 4. If desired to provide more room for mounting the photocell, the photocell may be located remotely from the aperture 160 and a bundle of fiber optic lines may be used to conduct light from the width of the aperture 160 to the remote photocell 164.

The light rays 170 (FIG. 6) from the source 142 can normally reach the photocell 164, and the aperture 160 is offset slightly to the right of the line 36. If desired, the right feed dog 24 may be shortened to provide room for the optical sensing element 160, 164 in the position shown in FIG. 4.

When the contrasting portion of the workpiece, for example the edge thereof, is exactly centered over the aperture 160, then an intermediate amount of light energy reaches the cell 164 and the revolvable control means 31 remains stationary. This intermediate position corresponds with the null point in the response of the control circuit 110 to the photocell, and therefore the revolvable control means 31 is held stationary by the reversible drive motor 52. Thus, the control contacting means 31 exerts a straight guidance restraint on the fabric region 34, which is directly aligned with the line 36, and so the fabric region 34 moves forward along the line 36 straight toward the needle work point P.

When, during the stitching operation, the contrasting portion of the workpiece W begins to move toward the left from the centered position over the aperture 160, then the amount of light energy reaching the photocell 164 begins to increase, because more of the photocell is fully exposed to the light rays 170. Immediately, the reversible motor 52 is turned in a direction to move the revolvable control contacting means 31 in the direction R (FIG. 4) laterally across the region 34. Thus, the fabric region 34 is automatically immediately shifted to the right to bring the contrasting portion of the workpiece back into centered relationship over the aperture 160, thus guiding the fabric material into the correct position for the desired stitching path to be produced.

Conversely, when during the stitching operation, the contrasting portion of the workpiece W begins to move toward the right, the amount of light energy now reaching the photocell 164 begins to decrease from the intermediate value. Immediately the motor 52 is turned in the opposite direction causing the revolvable control means 31 to move in the direction L (FIG. 4) laterally across the region 34. Thereby, the fabric region 34 is automatically shifted to the left to bring the contrasting portion of the workpiece back into centered relationship with respect to the sensing means 140. In this way, the fabric material is immediately guided to produce the desired stitching path.

As explained above, straight, curved, circular, reverse curved, S-curved and irregularly curved stitching paths can be automatically followed.

A stop cycle button 176 enables the operator to discontinue a stitching cycle, and a reset button 178 resets the control unit in readiness for the next cycle.

In FIG. 4, in dashed outline, is shown an illustrative workpiece W, and the apparatus 30 is automatically guiding the fabric material to sew a stitching path 180 following along near, but uniformly offset from, a contrasting portion 182 of this workpiece. This offset is substantially equal to the amount by which the aperture 160 is offset from the line 36. In this example, the contrasting portion 182 is a contoured edge of the workpiece. There is a relatively great contrast occurring between the unobstructed light rays passing by the edge 182 to reach the right portion of the photocell 164 and the obstructed light rays which are blocked, absorbed or reflected by the edge of the workpiece, and thus only light rays of greatly diminished intensity may reach the left portion of this photocell. Accordingly, the control knob 172 can be adjusted for the motor 52 to be stationary when the edge of the workpiece is centered over the aperture 160.

Conversely, when the contrasting portion of the workpiece being followed is a second ply on top of the first ply, then the light intensity which reaches the photocell is less, and the control means 146 and 172 may be adjusted accordingly.

The electronic control 110 may count the number of stitches being made, and when the desired count is reached, the sewing machine motor 120 is stopped to discontinue the work operation. This counting may be accomplished by magnetic proximity sensing means 124 positioned near to a rotating part of the sewing machine having magnetically permeable structure, for example such as a steel crank shaft with a revolving crank arm. The sensing means 124 is connected by leads 126 to the control circuit 110, and each revolution of the crank arm (or other proximate magnetically permeable part of the sewing machine) generates a signal voltage in the sensing means 124 which is fed through the leads 126 to the control circuit 110. Alternatively, a photocell sensor may be provided to sense the end of the workpiece for discontinuing the work operation.

It is to be understood that the sewing machine 10 is equipped with an electromagnetic brake (not shown), so that this machine is brought to a quick stop and is locked in position with the needle 16 in its inactive position fully spaced away from the fabric, when the motor 120 is deenergized. A suitable system for assuring that the sewing machine always is topped with the needle in its inactive position is shown in U.S. Pat. No. 3,463,103.

At the conclusion of the stitching cycle; that is, after the desired stitch count is reached and the needle is inactive, then the guide apparatus 30 is arranged to kick the workpiece away from the work point. The control 110 causes the servo motor 52 to drive the revolvable control means 31 at high speed in either the L or R (FIG. 4) direction, so as to quickly shift the workpiece away from the work point.

FIG. 7 shows automatic fabric guiding apparatus 30A as another embodiment of the invention in which the revolvable control means 31 includes a stiffly flexible plastic disc 32A, for example of polypropylene, clamped to a hub 38 which is freely rotatably mounted by bearing means 46 on a carriage 48. The lower surface of the disc 32A, as shown in FIG. 8 has a plurality of shallow, radially extending lands or ridges 180 separated by grooves 182. These lands 180 allow the workpiece W to slide and advance relatively freely toward the workpoint. However, when the control means 31 is revolving toward the left or right, as indicated in FIG. 4 these lands exert a laterally acting frictional drag upon the localized region 34 of the workpiece closely in front of the workpoint P. Thus, a differential frictional engagement effect is achieved by this radially ribbed texture of the lower surface of the stiffly flexible disc 32A. A frictional force is thereby exerted in a lateral direction L or R on the fabric surface during rotation of the revolvable control means 31 for guiding the workpiece as contrasted with the freely slidable advancing movement of the workpiece toward the workpoint.

An annular ring 184 of material having a high coefficient of friction, for example fine sandpaper, is glued tothe upper surface of the disc 32A. The purpose of this high friction means 184 is to provide traction so that a rubber-tired pressure wheel 70 can readily turn the revolvable control means 31. The wheel 70 is fixed to the drive shaft 56 of a servo motor 52 which is mounted on trunnions 186 in the carriage 48 secured to a support arm 64 similar to the support arm shown in FIGS. 1 and 3.

In order to urge the drive wheel 70 down against the revolvable control means 31, force exerting means 188 for example such as a spring is provided. This spring 188 also causes the drive wheel 70 to press a localized peripheral portion of the lower surface of the disc 32A down into engagement with the workpiece.

It is to be noted that the automatic fabric guiding apparatus 30A is well adapted to engage a localized region 34 (FIG. 4) of the workpiece W immediately in front of the workpoint closely adjacent thereto without conflicting with the sewing components 14, 16, 24, 26, 28 near the workpoint P.

It is to be understood that the sensing means and control circuit means shown in FIG. 6 may also be utilized with the various embodiments of the workpiece guiding apparatus shown in FIGS. 7 through 8.

We claim:

1. Apparatus for automatically controlling movement of a fabric workpiece with respect to a workpoint in a fastening machine which includes feed means for feeding the fabric workpiece along a line of approach toward the workpoint with fastening means acting at the workpoint for performing fastening of the fabric workpiece, said apparatus comprising revolvable contacting means for contacting the fabric workpiece, mounting means rotatably mounting said contacting means in a position for engaging only a localized region of the fabric workpiece, said localized region of the fabric workpiece being directly in front of the workpoint and being on said line of approach, said mounting means holding said revolvable contacting means continuously in contact with the fabric workpiece directly in front of the workpoint as the fabric workpiece is moving toward the workpoint along said line of approach, reversible drive means for revolving said contacting means in either direction for moving said localized region of the workpiece either to the left or right laterally with respect to said line of approach, and control means connected to said reversible drive means for controlling its operation.

2. Apparatus for automatically controlling movement of a fabric workpiece with respect to a workpoint in a fastening machine as claimed in claim 1, in which:

said revolvable contacting means includes means for engaging the surface of the fabric workpiece for providing an increased coefficient of friction for lateral motion across the surface of the fabric workpiece in the direction to the left or right with respect to said line of approach as compared with the coefficient of friction across the surface of the fabric workpiece in the direction parallel with said line of approach.

3. Apparatus for automatically controlling movement of a fabric workpiece with respect to a workpoint in a fastening machine as claimed in claim 2, in which:

said revolvable contacting means has a ribbed configuration which is in continuous contact with the surface of the fabric workpiece in said localized region, said ribs extending in the direction parallel to said line of approach toward the workpoint at said localized region where said ribs are continuously in contact with the fabric workpiece for allowing the workpiece to advance relatively freely toward the workpoint while exerting an increased coefficient of friction laterally with respect to said line of approach when said revolvable contacting means is moving laterally across the fabric workpiece.

4. Apparatus for automatically controlling movement of a fabric workpiece with respect to a workpoint in a fastening machine as claimed in claim 3, in which:

said revolvable contacting means includes a stiffly flexible member revolvable about a hub, said hub being positioned in front of the workpoint and above said line of approach, and said ribbed configuration extends outwardly from the hub.

5. Apparatus for automatically controlling movement of a fabric workpiece with respect to a workpoint in a fastening machine as claimed in claim 4, in which:

said stiffly flexible member has a disc shape with a radial ribbed configuration associated therewith, and a pressure wheel positioned in front of said workpoint and above said line of approach runs against and presses down upon a peripheral area of said member for pressing a portion of said ribbed configuration against said localized region of the workpiece.

6. Apparatus for automatically controlling movement of a fabric workpiece with respect to a workpoint in a fastening machine as claimed in claim 5, in which:

said pressure wheel is connected to said reversible drive means to be driven thereby for turning said stiffly flexible member.

7. Apparatus for automatically controlling movement of a fabic workpiece with respect to a workpoint in a fastening machine as claimed in claim 1, in which:

said feed means for feeding the fabric workpiece along a line of approach toward the workpoint includes a pair of reciprocatable feed dogs positioned on opposite sides of said line of approach, one of said feed dogs being shorter on the front end thereof facing toward the approaching fabric workpiece, said control means including photocell means positioned off to one side of said line of approach on the side thereof where the shorter feed dog is located, and said photocell means being positioned in front of said shortened front end of said feed dog and near thereto.

8. Apparatus for automatically guiding fabric material for use with a sewing machine having a support for supporting the fabric material, a reciprocating needle which intermittently moves to pierce the fabric material on the support at a workpoint during the stitching strokes of the needle, and feed mechanism which mechanically advances the material over the support along a line of approach past the work point, said apparatus for automatically guiding the fabric material comprising:

alternate directional movable fabric contacting means, mounting means movably mounting said fabric contacting means for lateral motion to the left or right with respect to the line of approach and positioning said contacting means for continuously engaging a localized region of the fabric material on said line of approach in front of the work point and in close proximity to the work point as the fabric material advances along said line of approach over the support, reversible drive means for moving said fabric contacting means laterally toward the right or left while said contacting means is in continuous contact with said localized region of the fabric material for laterally steering the region of the fabric material in front of the work point, and control means for operating said reversible drive means.

9. Apparatus for automatically guiding fabric material for use with a sewing machine, as claimed in claim 8, in which:

said movable fabric contacting means includes means for providing a greater coefficient of friction against the fabric material in a direction laterally toward the left and right with respect to said line of approach as compared with the coefficient of friction in the direction along said line of approach.

10. Apparatus for automatically guiding fabric material for use with a sewing machine, as claimed in claim 9, in which:

said means for providing a greater coefficient of friction includes lands with grooves therebetween, engageable with the fabric material, said lands extending in the direction of said line of approach in said localized region of engagement with the fabric material.

11. Apparatus for automatically guiding fabric material for use with a sewing machine, as claimed in claim 9, in which:

said reversible drive means is an electric motor having an output shaft driven thereby, and said rotatable member is mounted on said output shaft.

12. Apparatus for automatically guiding fabric material for use with a sewing machine as claimed in claim 8, in which:

said support for supporting the fabric material includes an opening therein beneath said localized region of the fabric material, and means engaging the lower surface of said fabric material through said opening for reducing the frictional drag on the fabric material.

13. Automatic fabric workpiece guiding apparatus adapted for use with a fabric fastening machine having a workpoint at which the fastening operation takes place and having a line of approach toward said workpoint along which the fabric advances toward said workpoint, said apparatus comprising:

a reversible electric motor having an output shaft, rotatable means having fabric contacting means for engaging the surface of the fabric, said rotatable means being driven by said output shaft, mounting means for mounting said reversible electric motor with said output shaft and with said rotatable means both being positioned in front of said workpoint for bringing said fabric contacting means into contact with the surface of a fabric workpiece in a localized region which is located entirely in front of said workpoint, said localized region being on said line of approach and being in close proximity to said workpoint, said reversible motor serving in operation to rotate said rotatable means in either direction for moving said fabric contacting means to the left and right relative to said line of approach in said localized region, and control means connected to said reversible electric motor for controlling its operation.

* * * * *